US010619478B2

(12) United States Patent
He et al.

(10) Patent No.: US 10,619,478 B2
(45) Date of Patent: Apr. 14, 2020

(54) DEVICE FOR POWER TRANSMISSION AND SIGNAL TRANSFER BETWEEN STATOR AND ROTOR OF SCREW DRILLING TOOL

(71) Applicant: Institute of Geology and Geophysics, Chinese Academy of Sciences, Beijing (CN)

(72) Inventors: Xinzhen He, Beijing (CN); Qingyun Di, Beijing (CN); Wenxuan Chen, Beijing (CN); Jiansheng Du, Beijing (CN); Qingbo Liu, Beijing (CN); Yongyou Yang, Beijing (CN)

(73) Assignee: INSTITUTE OF GEOLOGY AND GEOPHYSICS CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/556,169

(22) Filed: Aug. 29, 2019

(65) Prior Publication Data

US 2020/0003049 A1 Jan. 2, 2020

Related U.S. Application Data

(63) Continuation of application No. PCT/CN2018/123969, filed on Dec. 26, 2018.

(30) Foreign Application Priority Data

Jun. 28, 2018 (CN) ..... 2018 1 0690436

(51) Int. Cl.
*E21B 47/12* (2012.01)
*E21B 4/04* (2006.01)
(Continued)

(52) U.S. Cl.
CPC ..... *E21B 47/122* (2013.01); *E21B 4/04* (2013.01); *E21B 7/022* (2013.01); *E21B 15/045* (2013.01); *E21B 47/124* (2013.01)

(58) Field of Classification Search
CPC ..... E21B 47/122; E21B 15/045; E21B 4/04; E21B 7/022; E21B 47/124; E21B 47/12; E21B 4/02
(Continued)

(56) References Cited

U.S. PATENT DOCUMENTS 6,540,032 B1 * 4/2003 Krueger ..... E21B 17/028 175/40
7,303,007 B2 * 12/2007 Konschuh ..... E21B 4/02 166/250.01
(Continued)

FOREIGN PATENT DOCUMENTS

CN 101737009 6/2010
CN 201666117 12/2010
(Continued)

OTHER PUBLICATIONS

Search Report of PCT/CN2018/123969.
Written Opinion of PCT/CN2018/123969.

*Primary Examiner* — Brian Wilson
(74) *Attorney, Agent, or Firm* — Dragon Sun Law Firm, PC; Jinggao Li, Esq.

(57) ABSTRACT

The present disclosure provides a device for power transmission and signal transfer between the stator and the rotor of a screw drilling tool. The present disclosure can replace the wireless communication technique between the rotary steering tool and the integrated MWD/LWD, omit the upper mud generator above the rotary steering tool, and thereby realize power transmission and signal transfer between the stator and the rotor of the screw drilling tool.

7 Claims, 2 Drawing Sheets

(51) Int. Cl.
*E21B 7/02* (2006.01)
*E21B 15/04* (2006.01)

(58) Field of Classification Search
USPC ..... 340/854.3, 854.4, 854.6, 854.9
See application file for complete search history.

(56) References Cited

U.S. PATENT DOCUMENTS

| | | | | |
|---|---|---|---|---|
| 8,162,044 | B2 * | 4/2012 | Sihler | E21B 4/02 166/105 |
| 8,627,901 | B1 | 1/2014 | Underwood et al. | |
| 2007/0251729 | A1 | 11/2007 | Sand et al. | |
| 2013/0056272 | A1 | 3/2013 | Kuckes | |

FOREIGN PATENT DOCUMENTS

| | | |
|---|---|---|
| CN | 102937022 | 2/2013 |
| CN | 103835705 | 6/2014 |
| CN | 106639898 | 5/2017 |
| CN | 106677760 | 5/2017 |
| CN | 107100924 | 8/2017 |
| CN | 107780833 | 3/2018 |
| CN | 108979523 | 12/2018 |
| WO | 2007124567 | 11/2007 |
| WO | 2014158645 | 10/2014 |

* cited by examiner

DEVICE FOR POWER TRANSMISSION AND SIGNAL TRANSFER BETWEEN STATOR AND ROTOR OF SCREW DRILLING TOOL

CROSS-REFERENCE TO RELATED APPLICATIONS

This application is a bypass continuation application of PCT Application No. PCT/CN2018/123969, This Application claims priority from PCT Application No. PCT/CN2018/123969, filed Dec. 26, 2018, and Chinese Patent Application No. 201810690436.6, filed Jun. 28, 2018, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to logging while drilling technology, and more particularly relates to a device for power transmission and signal transfer between the stator and the rotor of a screw drilling tool.

BACKGROUND OF THE DISCLOSURE

The power of a rotary steering tool is provided by a surface drilling rig. However, in the drilling operation in a deep well or extra-deep well, the rotary steering tool can't obtain high rotation speed and torque from the surface drilling rig owing to a fact that the friction resistance on the downhole casing and drilling string is increased. In such a case, a screw drilling tool may be used to provide power to the downhole steering tool. A high-performance screw drilling tool may be disposed between the rotary steering tool and an integrated MWD/LWD to provide high rotation speed and high torque to the rotary steering tool, so as to improve the drilling efficiency. In that way, it is unnecessary for the surface drilling rig to provide an excessively high rotation speed. Thus, the wear and fatigue of the upper casing, drilling string, and drilling tool assembly above the screw drilling tool can be reduced significantly, so that the risk and cost can be reduced. Since the rotary steering system requires electric power supply and communication with the integrated MWD/LWD, power transmission and signal transfer through the screw must be realized, so as to supply the electric power generated by the upper generator to the rotary steering tool through the screw drilling tool, transfer the data measured by the rotary steering tool near the drill bit and the working state information of the rotary steering tool to the upper drilling tool assembly through the screw drilling tool, and transfer the steering commands from the upper downhole central control system to the steering tool through the screw drilling tool.

For the communication between the rotary steering tool and the integrated MWD/LWD, usually a wireless communication technique is used in the prior art. Specifically, receiving and transmitting antennae are installed on the integrated MWD/LWD and the rotary steering tool, and communication is provided with an electromagnetic wave technique. However, that approach hasn't solved the problem of electric power supply to the rotary steering tool.

Therefore, a heretofore unaddressed need exists in the art to address the aforementioned deficiencies and inadequacies

SUMMARY OF THE DISCLOSURE

In order to solve the above problem, the present disclosure provides a device for power transmission and signal transfer between the stator and the rotor of a screw drilling tool, which has a simple structure, can convert the planetary movement of the rotor in an accommodating cavity of the stator into coaxial movement so as to eliminate any axial displacement of the rotor in the accommodating cavity of the stator, and can transfer electric power and signals from the rotor in the motor assembly to an external centralizer that is stationary with respect to the rotor, and thereby realize power transmission and signal transfer between the stator and the rotor of the screw drilling tool via the external centralizer.

Technical scheme: a device for power transmission and signal transfer between the stator and the rotor of a screw drilling tool, comprising an electric power and signal transmitting portion, an electric power and signal receiving portion, and a transfer portion, wherein, the electric power and signal transmitting portion and the electric power and signal receiving portion are configured to transfer electric power and signals generated by a mud generator in a contactless manner;

the transfer portion is configured to transfer the electric power and signals to the rotor, so that the electric power and signals are further transmitted downward through a main body of the screw drilling tool;

both the electric power and signal transmitting portion and the electric power and signal receiving portion are disposed inside a drill collar, the electric power and signal transmitting portion is connected through a wire to the mud generator and a measurement while drilling (MWD)/logging while drilling (LWD) instrument, and the electric power and signal receiving portion is mechanically connected via the transfer portion to the rotor, wherein the electric power and signals are transferred through the wire to the rotor.

Furthermore, the electric power and signal transmitting portion and the electric power and signal receiving portion comprise an external centralizer, an internal centralizer, an external excitation coil, an internal excitation coil, an electric excitation transmitting circuit board, and an electric excitation receiving circuit board;

wherein, the external centralizer is fixedly connected inside the drill collar, the internal centralizer is mounted inside the drill collar via a mud bearing, one end of the external centralizer contacts with one end of the internal centralizer, a wire through-hole and a fan-shaped mud flow channel are provided inside the external centralizer and the internal centralizer respectively, an transmitting circuit compartment is provided at the other end of the external centralizer, the electric excitation transmitting circuit board is arranged inside the transmitting circuit compartment, and the transmitting circuit compartment is sealed by a transmitting circuit compartment cover, a receiving circuit compartment is provided at one end of the internal centralizer, the electric excitation receiving circuit board is arranged inside the receiving circuit compartment, and the receiving circuit compartment is sealed by a receiving circuit compartment cover, the internal excitation coil is arranged on the end of the internal centralizer that contacts with the external centralizer and is connected to the electric excitation receiving circuit board through a wire, the external excitation coil and the internal excitation coil are mounted concentrically without contact, and the external excitation coil is fixed to an inner side wall of the drill collar, the external excitation coil is connected to the electric excitation transmitting circuit board through the wire.

Furthermore, the transfer portion comprises a universal flexible shaft, an anti-releasing rod, an anti-releasing nut, a left high pressure electrical feedthru connector pin, a left high pressure electrical feedthru connector boot, a spiral coil, a right high pressure electrical feedthru connector boot, and a right high pressure electrical feedthru connector pin;

Wherein, a wire hole is provided inside the universal flexible shaft, a high pressure electrical feedthru connector compartment is provided inside the anti-releasing rod, wire holes are arranged in the two ends of the high pressure electrical feedthru connector compartment, the left high pressure electrical feedthru connector pin, the left high pressure electrical feedthru connector boot, the spiral coil, the right high pressure electrical feedthru connector boot, and the right high pressure electrical feedthru connector pin are arranged inside the high pressure electrical feedthru connector compartment, one end of the left high pressure electrical feedthru connector pin is connected a wire, the other end of the left high pressure electrical feedthru connector pin is inserted into the left high pressure electrical feedthru connector boot, the other end of the left high pressure electrical feedthru connector boot is connected to one end of the spiral coil, the other end of the spiral coil is connected to one end of the right high pressure electrical feedthru connector boot, one end of the right high pressure electrical feedthru connector pin is connected with a wire, and the other end of the right high pressure electrical feedthru connector pin is inserted inside the right high pressure electrical feedthru connector boot;

one end of the universal flexible shaft is tight-fitted with an end of the internal centralizer, the other end of the universal flexible shaft is inserted into one end of the anti-releasing rod and flexibly connected with the anti-releasing rod, the anti-releasing nut is arranged on the end of the universal flexible shaft that is connected with the anti-releasing rod, the other end of the anti-releasing rod extends out of the drill collar and tight-fitted with the rotor through threads.

Furthermore, the anti-releasing rod is further provided with a pressure balance hole, which is connected to the high pressure electrical feedthru connector compartment.

Furthermore, the universal flexible shaft is connected with the anti-releasing rod by means of a key-slot connection.

Furthermore, the universal flexible shaft is made of a titanium alloy or magnesium-aluminum alloy.

Furthermore, the universal flexible shaft is in 270-400 mm length and 12-15 mm diameter, and the wire hole in the universal flexible shaft is in 2.5-5 mm diameter.

Furthermore, the anti-releasing nut is connected with the anti-releasing rod via threads, made of alloy steel, in 95-100 mm diameter and 27-50 mm thickness.

Benefits: with the above technical scheme, the present disclosure can solve the technical problem of power transmission and signal transfer through a screw, and thereby the upper mud generator above the rotary steering tool can be omitted, the downhole drilling tool assembly can be simplified, the well drilling risks can be decreased; in addition, the downhole drilling tool can be shorted, the build-up rate of the rotary steering tool can be improved, and the mechanism and structure are simple. The present disclosure can replace the technique of wireless communication between the rotary steering tool and the integrated MWD/LWD, omit the upper mud generator above the rotary steering tool, and thereby realize power transmission and signal transfer between the stator and the rotor of the screw drilling tool.

BRIEF DESCRIPTION OF DRAWINGS

The accompanying drawings illustrate one or more embodiments of the present disclosure and, together with the written description, serve to explain the principles of the invention. Wherever possible, the same reference numbers are used throughout the drawings to refer to the same or like elements of an embodiment.

In the figures.

1—drill collar; 2—external centralizer; 3—transmitting circuit compartment cover; 4—electric excitation transmitting circuit board; 5—transmitting circuit compartment; 6—mud flow channel; 7—internal centralizer; 8—mud bearing; 9—external excitation coil; 10—internal excitation coil; 11—receiving circuit compartment; 12—receiving circuit board compartment cover; 13—electric excitation receiving circuit board; 14—flex shaft; 15—high pressure electrical feedthru connector compartment; 16—anti-releasing nut; 17—anti-releasing rod; 18—left high pressure electrical feedthru connector pin; 19—left high pressure electrical feedthru connector boot; 20—spiral coil; 21—right high pressure electrical feedthru connector boot; 22—right high pressure electrical feedthru connector pin; 23—pressure balance hole; 24—rotor; 25—stator; 26—stator rubber; 27—wire; 28—wire support; 29—wire hole.

DETAILED DESCRIPTION OF THE EMBODIMENTS

Hereunder the technical scheme of the present disclosure will be further detailed with reference to the accompanying drawings.

Figure 1:
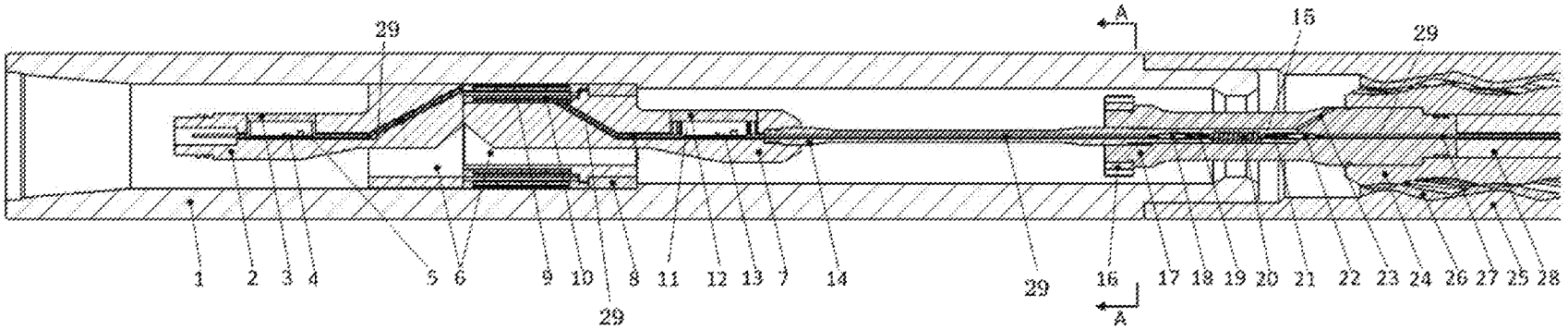
FIG. 1 is a schematic structural diagram of the device for power transmission and signal transfer between the stator and the rotor of a screw drilling tool in the present disclosure.
Figure 2:
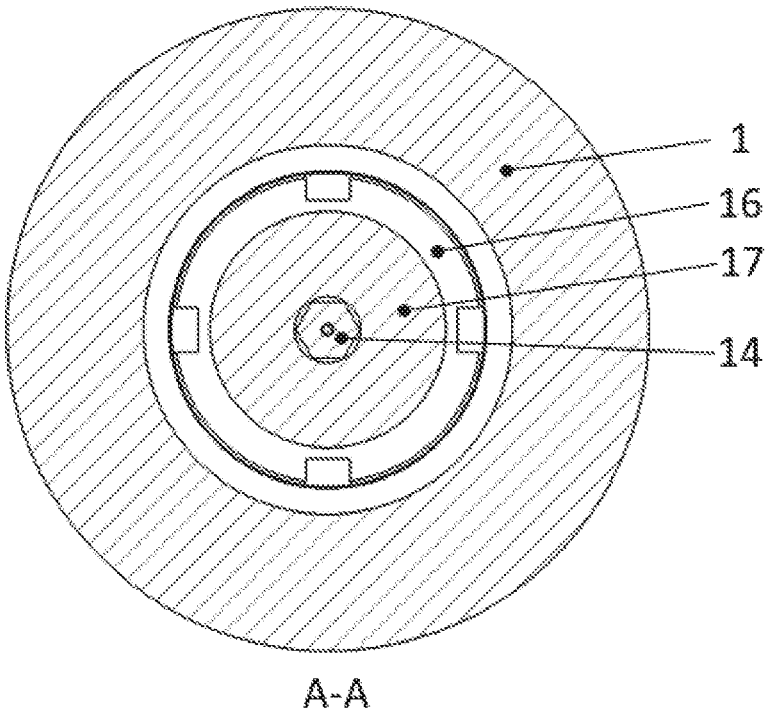
FIG. 2 is a sectional view A-A of the device for power transmission and signal transfer between the stator and the rotor of a screw drilling tool in the present disclosure.

As shown in FIGS. 1-2, the present disclosure provides a device for power transmission and signal transfer between the stator and the rotor of a screw drilling tool, which comprises an electric power and signal transmitting portion, an electric power and signal receiving portion, and a transfer portion, wherein, the electric power and signal transmitting portion and the electric power and signal receiving portion are configured to transfer electric power and signals generated by a mud generator in a non-contact manner;

the transfer portion is configured to transfer the electric power and signals to the rotor, so that the electric power and signals are further transmitted downward through a main body of the screw drilling tool.

Both the electric power and signal transmitting portion and the electric power and signal receiving portion are disposed inside a drill collar, the electric power and signal transmitting portion is connected through a wire to the mud generator and a measurement while drilling (MWD)/logging while drilling (LWD) instrument, and the electric power and signal receiving portion is mechanically connected via the transfer portion to the rotor, wherein the electric power and signals are transferred through the wire to the rotor.

Furthermore, the electric power and signal transmitting portion and the electric power and signal receiving portion comprise an external centralizer 2, an internal centralizer 7, an external excitation coil 9, an internal excitation coil 10, an electric excitation transmitting circuit board, and an electric excitation receiving circuit board 13;

wherein, the external centralizer 2 is fixedly connected inside the drill collar 1, the internal centralizer 7 is mounted inside the drill collar 1 via a mud bearing 8, one end of the external centralizer 2 contacts with one end of the internal centralizer 7, a wire through-hole 29 and a mud flow channel 6 are provided inside the external centralizer 2 and the internal centralizer 7 respectively, an transmitting circuit compartment 5 is provided at the other end of the external centralizer 2, the electric excitation transmitting circuit board 4 is arranged inside the transmitting circuit compartment 5, and the transmitting circuit compartment 5 is sealed by a transmitting circuit compartment cover 3, a receiving circuit compartment 11 is provided at one end of the internal centralizer 7, the electric excitation receiving circuit board 13 is arranged inside the receiving circuit compartment 11, and the receiving circuit compartment 11 is sealed by a receiving circuit compartment cover 12, the internal excitation coil 10 is arranged on an outer sidewall of the internal centralizer 7 at the end of the internal centralizer 7 that contacts with the external centralizer 2 and is connected to the electric excitation receiving circuit board 13 through a wire 27, the external excitation coil 9 and the internal excitation coil 10 are mounted concentrically without contact, and the external excitation coil 10 is fixed to an inner side wall of the drill collar 1, the external excitation coil 9 is connected to the electric excitation transmitting circuit board 4 through the wire 27.

Furthermore, the transfer portion comprises a universal flexible shaft 14, an anti-releasing rod 17, an anti-releasing nut 16, a left high pressure electrical feedthru connector pin 18, a left high pressure electrical feedthru connector boot 19, a spiral coil 20, a right high pressure electrical feedthru connector boot 21, and a right high pressure electrical feedthru connector pin 22;

wherein, a wire hole 29 is provided inside the universal flexible shaft 14, a high pressure electrical feedthru connector compartment 15 is provided inside the anti-releasing rod 17, wire holes 29 are arranged in the two ends of the high pressure electrical feedthru connector compartment 15, the left high pressure electrical feedthru connector pin 18, the left high pressure electrical feedthru connector boot 19, the spiral coil 20, the right high pressure electrical feedthru connector boot 21, and the right high pressure electrical feedthru connector pin 22 are arranged inside the high pressure electrical feedthru connector compartment 15, one end of the left high pressure electrical feedthru connector pin 18 is connected with a wire 27, the other end of the left high pressure electrical feedthru connector pin 18 is inserted into the left high pressure electrical feedthru connector boot 19, the other end of the left high pressure electrical feedthru connector boot 19 is connected to one end of the spiral coil 20, the other end of the spiral coil 20 is connected to one end of the right high pressure electrical feedthru connector boot 21, one end of the right high pressure electrical feedthru connector pin 22 is connected with a wire 27, and the other end of the right high pressure electrical feedthru connector pin 22 is inserted inside the right high pressure electrical feedthru connector boot 21;

one end of the universal flexible shaft 14 is tight-fitted with an end of the internal centralizer 7, the other end of the universal flexible shaft 14 is inserted into one end of the anti-releasing rod 17 and flexibly connected with the inside of the anti-releasing rod 17, the anti-releasing nut 16 is arranged on the end of the universal flexible shaft 14 that is connected with the anti-releasing rod 17, the other end of the anti-releasing rod 17 extends out of the drill collar 1 and tight-fitted with one end of the rotor 24 through threads.

Furthermore, the anti-releasing rod 17 is further provided with a pressure balance hole 23, which communicates with the high pressure electrical feedthru connector compartment 15 inside the anti-releasing rod 17.

Furthermore, the universal flexible shaft 14 is connected with the anti-releasing rod 17 by means of a key-slot connection.

Furthermore, the universal flexible shaft 14 is made of a titanium alloy or magnesium-aluminum alloy.

Furthermore, the universal flexible shaft 14 is in 270-400 mm length and 12-15 mm diameter, and the wire hole 29 in the universal flexible shaft 14 is in 2.5-5 mm diameter.

Furthermore, the anti-releasing nut 16 is connected with the anti-releasing rod 17 via threads, made of alloy steel, in 95-100 mm diameter and 27-50 mm thickness.

Example

The electric power generated by the upper mud motor and the communication signals between the rotary steering tool and the MWD/LWD instrument should be transferred via the screw drilling tool to the rotary steering tool. To realize power transmission and signal transfer through the screw, a wire 27 is lead through the main body of the screw drilling tool, the wire 27 is arranged inside a wire hole 29 in the external centralizer, internal centralizer, universal flexible shaft, and anti-releasing rod.

The mud flows through a mud flow channel 6 with a fan-shaped cross section via a port in the drill collar 1 and drives the rotor 24 to move in the accommodating cavity of the stator 25, and thereby the hydraulic energy of the mud is converted into mechanical energy.

The rotor 24 is a left handed screw structure, a stator rubber 26 is lined in the left-hand spiral cavity of the stator 25; the rotor 24 and the stator 25 have a special engagement relationship, forming a cycloidal conjugate curve pair; the rotor 24 and the stator rubber 26 form a sealed cavity; as the rotor 24 rotates in the stator 25, the seal cavity moves in the axial direction and occurs and disappear repeatedly, so that energy conversion is accomplished, i.e., the hydraulic energy of the mud is converted into mechanical energy.

The drill collar 1 is connected with the stator 25 through threads, the rotor 24 makes planetary movement inside the accommodating cavity of the stator 25, i.e., the axis of the rotor 24 rotates around the stator 25 while the rotor 24 itself rotates, and the rotor 24 has certain axial displacement inside the accommodating cavity of the stator 25.

The rotor 24 is connected with the anti-releasing rod 17 through threads, the anti-releasing rod 17 is slidably connected in a hex key slot in the universal flexible shaft 14, the universal flexible shaft 14 is connected with the internal centralizer 7 through threads, and the internal excitation coil 10 is mounted on the internal centralizer 7.

The anti-releasing nut 16 is connected with the anti-releasing rod 17 through threads to prevent the rotor 24 from dropping into the well from the accommodating cavity of the stator 25.

An absolute seal is arranged between the anti-releasing rod 17 and the rotor 24 to prevent mud intrusion.

An absolute seal is arranged between the universal flexible shaft 14 and the internal centralizer 7 to prevent mud intrusion.

The external centralizer 2, the external excitation coil 9, and the drill collar 1 are fixed together.

The rotor 24 transfers the planetary movement to the anti-releasing rod 17, the anti-releasing rod 17 is slidably connected in the hex key slot in the universal flexible shaft 14, i.e., axial relative movement is allowed between the anti-releasing rod 17 and the universal flexible shaft 14, and thereby the axial displacement of the rotor 24 inside the accommodating cavity of the stator 25 is eliminated.

A structure of pressure balance hole 23 is arranged in the anti-releasing rod 17 so that the pressure in the high pressure electrical feedthru connector compartment 15 in the anti-releasing rod 17 is balanced, and thereby the axial relative movement between the anti-releasing rod 17 and the universal flexible shaft 14 is realized.

The universal flexible shaft 14 is an elongated member that may have severe deflection and is easy to deform, and it converts the planetary movement transferred from the anti-releasing rod 17 into coaxial rotation of the internal excitation coil 10 and the external excitation coil 9 on the internal centralizer 7.

The mud bearing S supports the internal centralizer 7, so that the internal centralizer 7 can rotate coaxially with respect to the drill collar 1.

The electric power generated by the upper mud generator and the communication signals between the rotary steering tool and the MWD/LWD instrument are transferred through the electric connection formed by the wire 27 and the connectors to the external centralizer 2, then the direct current is converted by the electric excitation transmitting circuit board 4 into high-frequency alternating current and the signals are modulated in the high-frequency alternating current and then transferred through the wire 27 to the external excitation coil 9, the external excitation coil 9 generates a high-frequency alternating magnetic field and is inductively coupled with the internal excitation coil 10, the internal excitation coil 10 generates alternating current at the same frequency, and the alternating current is transferred through the wire 27 to the electric excitation receiving circuit board 13, the electric excitation receiving circuit board 13 converts the high-frequency alternating current into direct current, and separates and extracts the signals from the high-frequency alternating current.

The alternating magnetic field generated by the external excitation coil 9 directly passes through the mud between the external excitation coil 9 and the internal excitation coil 10 and is transferred by inductive coupling to the internal excitation coil 10, so that the transmission of electric power and signals with relative rotation is realized.

An absolute seal is arranged between the transmitting circuit compartment cover 3 and the external centralizer 2 and between the receiving circuit board compartment cover 12 and the internal centralizer 7, to prevention the mud from intruding into the circuit board compartments.

The electric power and signals received by the electric excitation receiving circuit board 13 are transferred through the wire 27 in the central wire hole 29 of the universal flexible shaft 14 to the high pressure electrical feedthru connector pin 18, and then is transferred through the high pressure electrical feed thru connector boot 19, the spiral coil 20, the high pressure electrical feedthru connector boot 21, the high pressure electrical feedthru connector pin 22, and the wire 27 to the central wire support 28 of the rotor 25, and the wire further runs downward through the main body of the screw drilling tool.

The high pressure electrical feedthru connector pin 18 and the high pressure electrical feedthru connector boot 19 are connected in a sealed manner prevent the mud from intruding into the universal flexible shaft 14 and the receiving circuit board compartment.

The high pressure electrical feedthru connector pin 22 and the high pressure electrical feedthru connector boot 21 are connected in a sealed manner to prevent the mud from intruding into the anti-releasing rod 17 and the wiring structure at the lower end.

The spiral wire 20 between the high pressure electrical feedthru connector boot 19 and the high pressure electrical feedthru connector boot 21 can extend and retract freely to adapt to the axial relative movement between the anti-releasing rod 17 and the universal flexible shaft 14.

While the present disclosure is described in detail above in an embodiment, that embodiment is only a preferred embodiment of the present disclosure, and shall not be deemed as constituting any limitation to the scope of the present disclosure. Any equivalent modification or improvement, etc. made on the basis of the scope of the present application shall be deemed as encompassed by the scope of patent of the present disclosure.

The foregoing description of the exemplary embodiments of the present disclosure has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A device for power transmission and signal transfer between a stator and a rotor of a screw drilling tool, comprising:

an electric power and signal transmitting portion;

an electric power and signal receiving portion; and a transfer portion, wherein the electric power and signal transmitting portion and the electric power and signal receiving portion are configured to transfer electric power and signals generated by a mud generator in a contactless manner;

the transfer portion is configured to transfer the electric power and signals to the rotor, so that the electric power and signals are further transmitted downward through a main body of the screw drilling tool;

both the electric power and signal transmitting portion and the electric power and signal receiving portion are disposed inside a drill collar, the electric power and signal transmitting portion is connected through a wire to the mud generator and a measurement while drilling (MWD)/logging while drilling (LWD) instrument; and the electric power and signal receiving portion is mechanically connected via the transfer portion to the rotor, wherein the electric power and signals are transferred through the wire to the rotor, wherein the electric power and signal transmitting portion and the electric power and signal receiving portion comprise an external centralizer, an internal centralizer, an external excitation coil, an internal excitation coil, an electric excitation transmitting circuit board, and an electric excitation receiving circuit board, wherein the external centralizer is fixedly connected inside the drill collar;

the internal centralizer is mounted inside the drill collar via a mud bearing; one end of the external centralizer contacts with one end of the internal centralizer;

a wire through-hole and a fan-shaped mud flow channel are provided inside the external centralizer and the internal centralizer, respectively;

a transmitting circuit compartment is provided at the other end of the external centralizer;

the electric excitation transmitting circuit board is arranged inside the transmitting circuit compartment;

the transmitting circuit compartment is sealed by a transmitting circuit compartment cover, a receiving circuit compartment is provided at one end of the internal centralizer;

the electric excitation receiving circuit board is arranged inside the receiving circuit compartment, and the receiving circuit compartment is sealed by a receiving circuit compartment cover;

the internal excitation coil is arranged on the end of the internal centralizer that contacts with the external centralizer and is connected to the electric excitation receiving circuit board through a wire;

the external excitation coil and the internal excitation coil are mounted concentrically without contact, and the external excitation coil is fixed to an inner side wall of the drill collar; and the external excitation coil is connected to the electric excitation transmitting circuit board through a wire.

2. A device for power transmission and signal transfer between a stator and a rotor of a screw drilling tool, comprising:

an electric power and signal transmitting portion;

an electric power and signal receiving portion; and a transfer portion, wherein the electric power and signal transmitting portion and the electric power and signal receiving portion are configured to transfer electric power and signals generated by a mud generator in a contactless manner;

the transfer portion is configured to transfer the electric power and signals to the rotor, so that the electric power and signals are further transmitted downward through a main body of the screw drilling tool;

both the electric power and signal transmitting portion and the electric power and signal receiving portion are disposed inside a drill collar, the electric power and signal transmitting portion is connected through a wire to the mud generator and a measurement while drilling (MWD)/logging while drilling (LWD) instrument; and the electric power and signal receiving portion is mechanically connected via the transfer portion to the rotor, wherein the electric power and signals are transferred through the wire to the rotor, wherein the transfer portion comprises a universal flexible shaft, an anti-releasing rod, an anti-releasing nut, a left high pressure electrical feedthru connector pin, a left high pressure electrical feedthru connector boot, a spiral coil, a right high pressure electrical feedthru connector boot, and a right high pressure electrical feedthru connector pin, wherein a wire hole is provided inside the universal flexible shaft;

a high pressure electrical feedthru connector compartment is provided inside the anti-releasing rod;

wire holes are arranged in two ends of the high pressure electrical feedthru connector compartment;

the left high pressure electrical feedthru connector pin, the left high pressure electrical feedthru connector boot, the spiral coil, the right high pressure electrical feedthru connector boot, and the right high pressure electrical feedthru connector pin are arranged inside the high pressure electrical feedthru connector compartment;

one end of the left high pressure electrical feedthru connector pin is connected with a wire;

the other end of the left high pressure electrical feedthru connector pin is inserted into the left high pressure electrical feedthru connector boot;

the other end of the left high pressure electrical feedthru connector boot is connected to one end of the spiral coil;

the other end of the spiral coil is connected to one end of the right high pressure electrical feedthru connector boot;

one end of the right high pressure electrical feedthru connector pin is connected with a wire;

the other end of the right high pressure electrical feedthru connector pin is inserted inside the right high pressure electrical feedthru connector boot;

one end of the universal flexible shaft is connected with an end of an internal centralizer in a seal way through screw threads;

the other end of the universal flexible shaft is inserted into one end of the anti-releasing rod and flexibly connected with the anti-releasing rod;

the anti-releasing nut is arranged on the end of the universal flexible shaft that is connected with the anti-releasing rod; and the other end of the anti-releasing rod extends out of the drill collar and connected with the rotor in a seal way through screw threads.

3. The device according to claim 2, wherein the anti-releasing rod is further provided with a pressure balance hole, which is connected to a high pressure electrical feedthru connector compartment.

4. The device according to claim 2, wherein the universal flexible shaft is connected with the anti-releasing rod through a key-slot connection.

5. The device according to claim 2, wherein the universal flexible shaft is made of a titanium alloy or magnesium-aluminum alloy.

6. The device according to claim 2, wherein, the universal flexible shaft is in 270-400 mm length and 12-15 mm diameter, and the wire hole in the universal flexible shaft is in 2.5-5 mm diameter.

7. The device according to claim 2, wherein the anti-releasing nut is connected with the anti-releasing rod via screw threads, and is made of alloy steel with 95-100 mm diameter and 27-50 mm thickness.

* * * * *